US011790833B2

(12) United States Patent
An et al.

(10) Patent No.: US 11,790,833 B2
(45) **Date of Patent: *Oct. 17, 2023**

(54) DISPLAY DEVICE AND AN INSPECTION METHOD THEREOF

(71) Applicant: SAMSUNG DISPLAY CO., LTD., Yongin-si (KR)

(72) Inventors: Jin Sung An, Yongin-si (KR); Seok Je Seong, Yongin-si (KR); Seong Jun Lee, Yongin-si (KR); Jae Hyun Lee, Yongin-si (KR); Yoon Jong Cho, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/520,877

(22) Filed: Nov. 8, 2021

(65) Prior Publication Data

US 2022/0059025 A1 Feb. 24, 2022

Related U.S. Application Data

(63) Continuation of application No. 17/024,812, filed on Sep. 18, 2020, now Pat. No. 11,170,704.

(30) Foreign Application Priority Data

Sep. 30, 2019 (KR) ..... 10-2019-0120878

(51) Int. Cl.
*G09G 3/32* (2016.01)

(52) U.S. Cl.
CPC ..... *G09G 3/32* (2013.01); *G09G 2310/0278* (2013.01)

(58) Field of Classification Search
CPC ..... G09G 2310/0278; G09G 3/32
See application file for complete search history.

(56) References Cited

U.S. PATENT DOCUMENTS

| | | | |
|---|---|---|---|
| 8,654,069 | B2 | 2/2014 | Mamba et al. |
| 9,595,213 | B2 | 3/2017 | Kim |
| 9,934,750 | B2 | 4/2018 | Park et al. |
| 10,861,393 | B2 | 12/2020 | Kim et al. |
| 2009/0045727 | A1 | 2/2009 | Kwak et al. |
| 2018/0293939 | A1 | 10/2018 | Kim et al. |
| 2021/0097930 | A1 | 4/2021 | An et al. |

FOREIGN PATENT DOCUMENTS

| | | |
|---|---|---|
| KR | 10-2014-0141375 | 12/2014 |
| KR | 10-2015-0100978 | 9/2015 |
| KR | 10-2018-0114981 | 10/2018 |
| KR | 10-2019-0034375 | 4/2019 |

*Primary Examiner* — Muhammad N Edun
(74) *Attorney, Agent, or Firm* — F. Chau & Associates, LLC

(57) ABSTRACT

A display device includes: a pixel unit including pixels connected to first scan lines, second scan lines, and data lines; a scan driver for supplying a first scan signal to the pixels through the first scan lines at a first frequency and supplying a second scan signal to the pixels through the second scan lines at a second frequency different from the first frequency in a first mode; a first signal supply for supplying an inspection signal to the pixels through at least one of the data lines in response to the first scan signal in a first period of the first mode; and a second signal for supply supplying a bias signal to the pixels through the data lines in response to the first scan signal in a second period of the first mode.

12 Claims, 11 Drawing Sheets

DISPLAY DEVICE AND AN INSPECTION METHOD THEREOF

CROSS-REFERENCE TO RELATED APPLICATIONS

This application is a continuation of U.S. patent application Ser. No. 17/024,812 filed on Sep. 18, 2020, which claims priority under 35 U.S.C. § 119 to Korean Patent Application No. 10-2019-0120878, filed Sep. 30, 2019, the disclosures of which are incorporated by reference herein in their entireties.

TECHNICAL FIELD

Exemplary embodiments of the present invention relate to an electronic device, and more particularly, to a display device and an inspection method thereof.

DISCUSSION OF RELATED ART

A display device is an output device for presentation of information in visual form, for example. A display device includes a plurality of pixels. Each of the pixels includes a plurality of transistors, a light emitting device electrically connected to the transistors, and a capacitor. When the transistors of a pixel are turned on, a predetermined driving current is generated. The light emitting device of the pixel emits light corresponding to this driving current.

In order to improve driving efficiency and minimize power consumption of the display device, a method of driving the display device at a low frequency is used. Therefore, there is a need to improve display quality when the display device is driven at the low frequency.

SUMMARY

A display device according to an exemplary embodiment of the present invention may include: a pixel unit including pixels connected to first scan lines, second scan lines, and data lines; a scan driver for supplying a first scan signal to the pixels through the first scan lines at a first frequency and supplying a second scan signal to the pixels through the second scan lines at a second frequency different from the first frequency in a first mode; a first signal supply for supplying an inspection signal to the pixels through at least one of the data lines in response to the first scan signal in a first period of the first mode; and a second signal for supply supplying a bias signal to the pixels through the data lines in response to the first scan signal in a second period of the first mode.

The second frequency may be lower than the first frequency.

The second scan signal may overlap the first scan signal.

The first scan signal and the second scan signal may be supplied in the first period and the first scan signal may be supplied in the second period.

The bias signal may be supplied to all of the pixels during the second period.

The first scan signal and the second scan signal may be supplied to the pixels through the first scan lines and the second scan lines, respectively, at the first frequency in a second mode.

The first scan signal and the second scan signal may be simultaneously supplied in the second mode.

The bias signal may not be supplied to the data lines in the second mode, and the inspection signal may be supplied to the pixels through the data lines in response to the first scan signal in the second mode.

The first signal supply may include: a first switch electrically connected between a first data line and a first inspection line that supplies a first inspection signal and the first switch is turned on by a first inspection control signal; a second switch electrically connected between a second data line and a second inspection line that supplies a second inspection signal and the second switch is turned on by a second inspection control signal; and a third switch electrically connected between a third data line and a third inspection line that supplies a third inspection signal and the third switch is turned on by a third inspection control signal.

At least one of the first, second and third switches may be turned on when the second scan signal is supplied.

The second signal supply may include a bias switch electrically connected between one of the data lines and a power source line that supplies the bias signal and the bias switch may be turned on by a bias control signal.

The first, second and third switches may be turned off when the bias switch is turned on.

The pixels may emit light in response to the inspection signal.

The display device may further include: an emission driver for supplying an emission control signal to the pixels through emission control lines at the first frequency; and a data driver for supplying a data signal to the pixels through the data lines.

A pixel disposed on an i-th horizontal line among the pixels (i is a natural number greater than 1) may include: a light emitting device; a first transistor including a first electrode connected to a first node electrically connected to a first power source, and controlling a driving current based on a voltage of a second node; a second transistor connected between one of the data lines and the first node, and turned on by the first scan signal supplied to an i-th first scan line; a third transistor connected between a third node connected to a second electrode of the first transistor and the second node, and turned on by the second scan signal supplied to an i-th second scan line; a fourth transistor connected between the third node and an initialization power source, and turned on by the second scan signal supplied to an (i−1)th second scan line; a fifth transistor connected between the first power source and the first node, and turned off by the emission control signal supplied to an i-th emission control line; and a sixth transistor connected between the third node and a first electrode of the light emitting device, and turned off with the fifth transistor.

The first signal supply may be disposed on a first side of the pixel unit and the second signal supply may be disposed on a second side of the pixel unit, and an area in which the data driver is mounted may be positioned between the pixel unit and the second signal supply.

According to an exemplary embodiment of the present invention, an inspection method of a display device driven in a low frequency mode may include: supplying an inspection signal to at least one of a plurality of data lines through a first signal supply in a first period of the low frequency mode; supplying a bias voltage to the data lines through a second signal supply in a second period of the low frequency mode subsequent to the first period; and performing lighting inspection of pixels emitting light in response to the inspection signal.

A frequency at which the first period is repeated may be equal to an image refresh rate.

The performing the lighting inspection may further include: detecting a change in the bias voltage from the data lines in a second period and performing a short inspection or an open inspection of the data lines.

A first scan signal and a second scan signal may be respectively supplied to a first scan line and a second scan line connected to each of the pixels during the first period, and the first scan signal may be supplied to the first scan line during the second period.

According to an exemplary embodiment of the present invention a display device may include: a pixel unit including pixels connected to a plurality of data lines; a first signal supply for supplying an inspection signal to at least one of the data lines in a first period of a low frequency mode; and a second signal for supply supplying a bias signal to the data lines in a second period of the low frequency mode, wherein the second period is after the first period and wherein the inspection signal is not supplied in the second period.

The bias signal may be provided to driving transistors of the pixels.

The first signal supply may include a plurality of switches connected to the data lines and configured to be activated by inspection control signals, and the second signal supply may include a plurality of switches connected to the data lines and configured to be activated by a bias control signal.

BRIEF DESCRIPTION OF THE DRAWINGS

The above and other features of the present invention will become more apparent by describing in detail exemplary embodiments thereof with reference to the accompanying drawings.

DETAILED DESCRIPTION OF THE EMBODIMENTS

Figure 1:
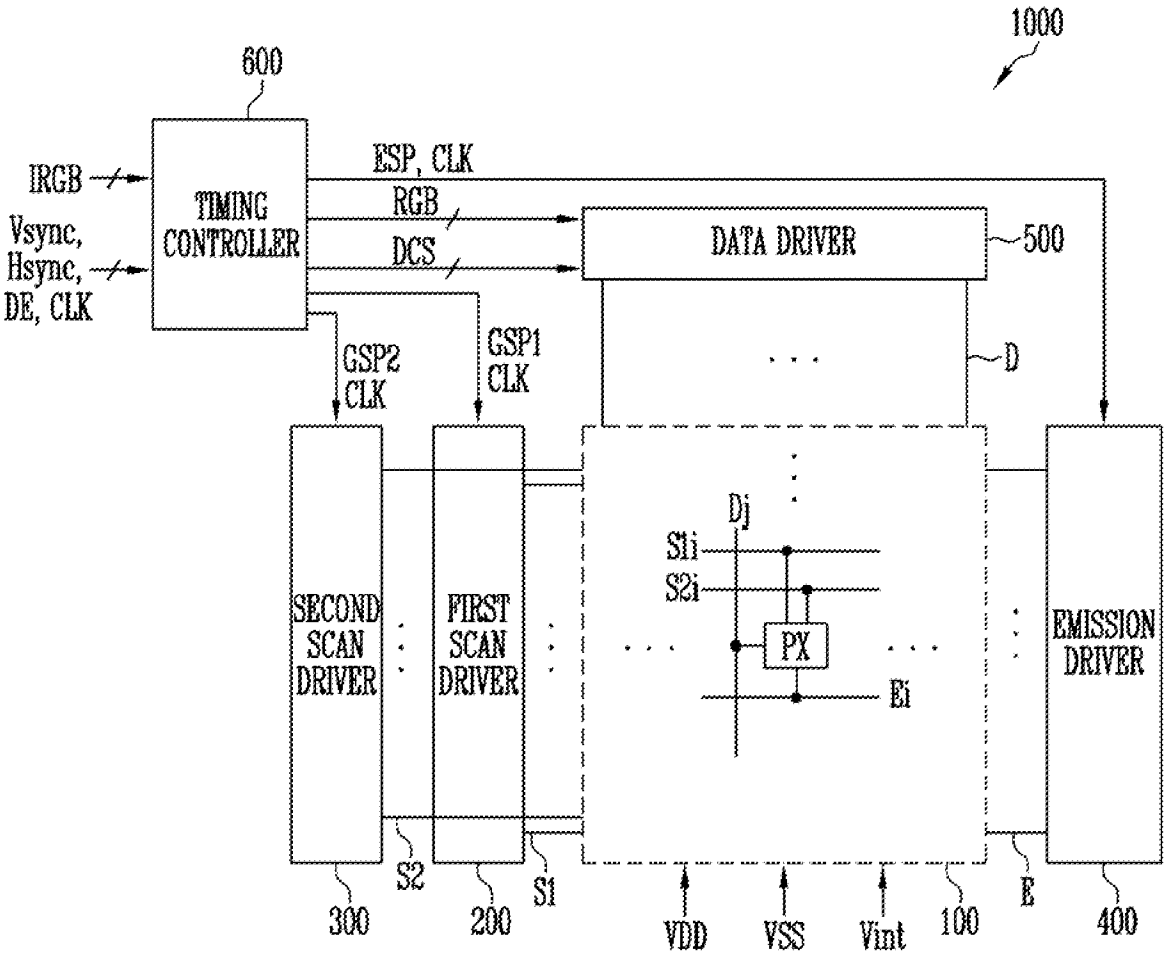
FIG. 1 is a block diagram illustrating a display device according to exemplary embodiments of the present invention.

Hereinafter, exemplary embodiments of the present invention will be described in detail with reference to the accompanying drawings. The same reference numerals may denote the same elements in the drawings, and thus, redundant explanations of the same or similar elements may be omitted.

FIG. 1 is a block diagram illustrating a display device according to exemplary embodiments of the present invention.

Referring to FIG. 1, a display device 1000 may include a pixel unit 100, first and second scan drivers 200 and 300, an emission driver 400, a data driver 500, and a timing controller 600.

The display device 1000 may display an image at various image refresh rates depending on driving conditions of the display device 1000. The image refresh rates may refer to a driving frequency or a screen refresh rate. The image refresh rate may be a frequency at which a data signal is written into a driving transistor of a pixel PX. For example, the image refresh rate, which may also be referred to as a screen scan rate or a screen display frequency, may represent a frequency of displaying a display signal for one second. In an exemplary embodiment of the present invention, the display device 1000 may adjust an output frequency of the second scan driver 300 and an output frequency of the data driver 500 depending on the driving conditions of the display device 1000. For example, the display device 1000 may display an image corresponding to various image refresh rates of 1 Hz to 120 Hz.

The pixel unit 100 may include a plurality of scan lines S1 and S2, a plurality of emission control lines E, a plurality of data lines D, and a plurality of pixels PX respectively connected to the scan lines S1 and S2, the emission control lines E, and the data lines D. Each of the pixels PX may include a driving transistor and at least one switching transistor.

The timing controller 600 may receive input image data IRGB and timing signals Vsync, Hsync, DE, and CLK from a host system such as an application processor (AP) through a predetermined interface.

The timing controller 600 may generate a data driving control signal DCS based on the timing signals such as the input image data IRGB, a vertical synchronization signal Vsync, a horizontal synchronization signal Hsync, a data enable signal DE, and a clock signal CLK. The data driving control signal DCS may be supplied to the data driver 500. The timing controller 600 may rearrange the input image data. IRGB and supply rearranged image data RGB to the data driver 500.

The timing controller 600 may supply first and second gate start pulses GSP1 and GSP2 and the clock signal to the first scan driver 200 and the second scan driver 300, respectively, based on the timing signals.

The timing controller 600 may supply an emission start pulse ESP and the clock signal CLK to the emission driver 400 based on the timing signals. The emission start pulse ESP may control the first timing of an emission control signal. The clock signal CLK may be used to shift the emission start pulse ESP.

The first gate start pulse GSP1 may control the first timing of a scan signal supplied from the first scan driver 200. The clock signal CLK may be used to shift the first gate start pulse GSP1.

The second gate start pulse GSP2 may control the first timing of a scan signal supplied from the second scan driver 300. The clock signal CLK may be used to shift the second gate start pulse GSP2.

The data driver 500 may receive the rearranged image data RGB from the timing controller 600, and supply a data signal to the data lines D in response to the data driving control signal DCS. The data signal supplied to the data lines D may be supplied to the pixels PX selected by the scan signal.

The data driver 500 may supply the data signal to the data lines D for one frame period according to the image refresh rate. For example, the data signal may be supplied so that they are synchronized with the scan signal supplied to the second scan lines S2.

The first scan driver 200 may supply the scan signal to the first scan lines S1 in response to the first gate start pulse GSP1. For example, the first scan driver 200 may sequentially supply a first scan signal to the first scan lines S1. Here, the first scan signal supplied from the first scan driver 200 may be set to a gate-on voltage so that the transistors included in the pixel PX can be turned on.

The second scan driver 300 may supply the scan signal to the second scan lines S2 in response to the second gate start pulse GSP2. For example, the second scan driver 300 may sequentially supply a second scan signal to the second scan lines S2. Here, the second scan signal supplied from the second scan driver 300 may be set to the gate-on voltage so that the transistor included in the pixel PX can be turned on.

The second scan driver 300 may control the scan signal supplied to the second scan lines S2 according to the image refresh rate. For example, the second scan driver 300 may sequentially supply the second scan signal to each of the second scan lines S2 at a frequency corresponding to the image refresh rate.

On the other hand, the first scan driver 200 may sequentially supply the first scan signal to each of the first scan lines S1 at a constant frequency regardless of a change in the image refresh rate. Therefore, when the display device 1000 is driven at a low frequency, a voltage for biasing (e.g., a bias voltage) may be supplied to each of the pixels PX in response to the first scan signal.

The emission driver 400 may supply the emission control signal to the emission control lines E in response to the emission start pulse ESP. For example, the emission driver 400 may sequentially supply the emission control signal to the emission control lines E. When the emission control signal is sequentially supplied to the emission control lines E, the pixels PX do not emit light in units of horizontal lines. To accomplish this, the emission control signal may be set to a gate-off voltage (for example, a logic high level) so that some transistors (for example, P-type transistors) included in the pixels PX may be turned off.

The emission control signal may be used to control the time at which the pixels PX emit light. To accomplish this, a width of the emission control signal may be than widths of the first and second scan signals. For example, the first scan driver 200 may supply the first scan signal to an (i−1)th first scan line S1*i*−1 (see FIG. 2) and an i-th first scan line S1*i* to overlap a gate-off period of the emission control signal supplied to an i-th emission control line Ei, wherein i is an integer of 2 or more.

In an exemplary embodiment of the present invention, the emission driver 400 mays sequentially supply the emission control signal to each of the emission control lines E at a constant frequency regardless of a change in the image refresh rate.

The first and second scan drivers 200 and 300 and the emission driver 400 may be mounted on a substrate through a thin film manufacturing process, respectively. In addition, the first scan driver 200 and the second scan driver 300 may be positioned at two sides of the pixel unit 100 with the pixel unit 100 interposed therebetween. The emission driver 400 may also be positioned at two sides of the pixel unit 100 with the pixel unit 100 interposed therebetween.

In FIG. 1, the first scan driver 200, the second scan driver 300, and the emission driver 400 respectively supply the first scan signal, the second scan signal, and the emission control signal, but the present invention is not limited thereto. For example, a scan signal and an emission control signal may be supplied by one driver.

Although FIG. 1 illustrates that the pixel PX disposed on the i-th horizontal line is connected to the i-th scan lines S1*i* and S2*i*, a j-th data line D and the i-th emission control line Ei, the present invention is not limited thereto. For example, according to a circuit structure of the pixels PX, the pixels PX positioned on the current horizontal line (or the current pixel row) may also be connected with the scan line positioned on the previous horizontal line (or the previous pixel row) and/or the scan line positioned on the subsequent horizontal line (or the subsequent pixel row). To accomplish this, dummy scan lines and/or dummy emission control lines, may be further formed in the pixel unit 100.

Figure 2:
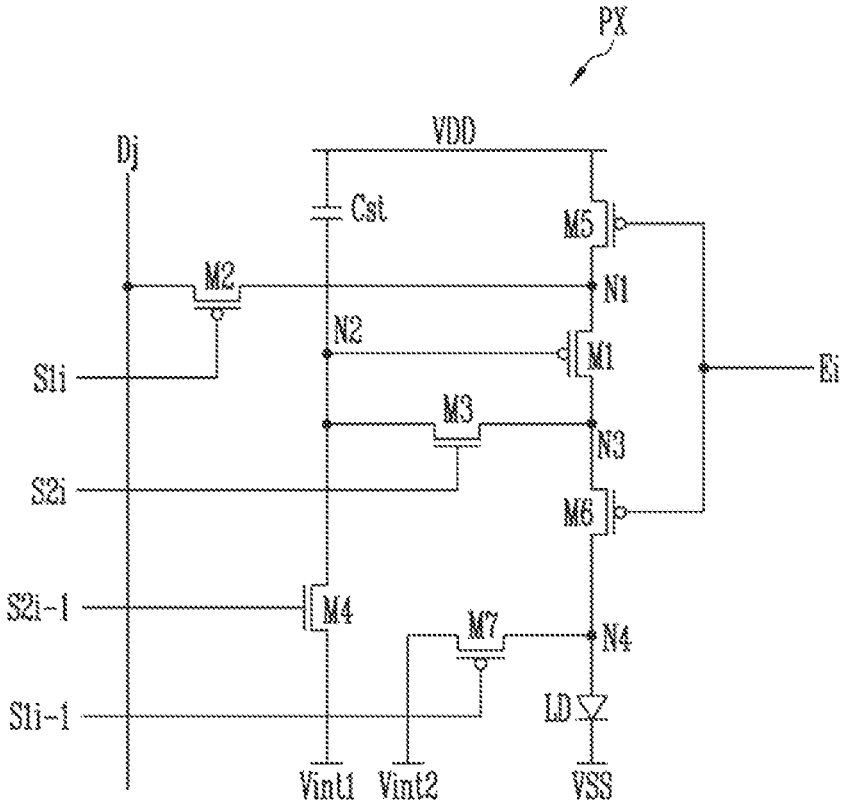
FIG. 2 is a circuit diagram illustrating an example of a pixel included in the display device of FIG. 1.

FIG. 2 is a circuit diagram illustrating an example of a pixel PX included in the display device 1000 of FIG. 1.

In FIG. 2, for convenience of description, the pixel PX positioned on the i-th horizontal line and connected to the j-th data line Dj will be illustrated.

Referring to FIG. 2, the pixel PX may include a light emitting device LD, first, second, third, fourth, fifth, sixth and seventh transistors M1, M2, M3, M4, M5, M6 and M7, and a storage capacitor Cst.

The light emitting device LD may include a first electrode (anode electrode or cathode electrode) connected to a fourth node N4 and a second electrode (cathode electrode or anode electrode) connected to a second power source VSS. The light emitting device LD may generate light of a predetermined luminance in response to the amount of current supplied from the first transistor M1.

In an exemplary embodiment of the present invention, the light emitting device LD may be an organic light emitting diode including an organic light emitting layer. In another exemplary embodiment of the present invention, the light emitting device LD may be an inorganic light emitting device formed of art inorganic material. The light emitting device LD may include a plurality of inorganic light emitting devices connected in parallel and/or in series between the second power source VSS and the fourth node N4.

The first transistor M1 (or a driving transistor) may include a first electrode connected to a first node N1, a second electrode connected to a third node N3, and a gate electrode connected to a second node N2. The first transistor M1 may control the amount of current flowing from a first power source VDD to the second power source VSS via the light emitting device LD in response to a voltage of the second node N2. To accomplish this, the first power source VDD may be a higher voltage than the second power source VSS.

The second transistor M2 may be connected between the j-th data line Dj and the first node N1. A gate electrode of the second transistor M2 may be connected to the i-th first scan line S1*i*. The second transistor M2 may be turned on when the scan signal (hereinafter, referred to as the first scan signal) is supplied to the i-th first scan line S1*i* so that the j-th data line Dj and the first node N1 may be electrically connected to each other.

The third transistor M3 may be connected between the second electrode of the first transistor M1 (for example, the third node N3) and the second node N2. A gate electrode of the third transistor M3 may be connected to the i-th second scan line S2*i*. The third transistor M3 may be turned on when the scan signal (hereinafter, referred to as the second scan signal) is supplied to the i-th second scan line S2*i* so that the second electrode of the first transistor M1 and the second node N2 may be electrically connected to each other. Therefore, when the third transistor M3 is turned on, the first transistor M1 may be connected in the form of a diode.

The fourth transistor M4 may be connected between the second node N2 and a first initialization power source Vint1. A gate electrode of the fourth transistor M4 may be connected to an (i−1)th second scan line S2*i*−1. The fourth transistor M4 may be turned on when the second scan signal is supplied to the (i−1)th second scan line S2*i*−1 so that a voltage of the first initialization power source Vint1 may be supplied to the second node N2. In this case, the voltage of the first initialization power source Vint1 may also be provided to the third transistor M3 and the storage capacitor Cst.

In an exemplary embodiment of the present invention, the voltage of the first initialization power source Vint1 may be set to a lower voltage than the data signal supplied to the j-th data line Dj. Accordingly, as the fourth transistor M4 is turned on, the gate voltage of the first transistor M1 may be initialized to the voltage of the first initialization power source Vint1, and thus, the first transistor M1 may be in an on-bias state (in other words, the first transistor M1 may be initialized to the on-bias state).

The fifth transistor M5 may be connected between the first power source VDD and the first node N1. A gate electrode of the fifth transistor M5 may be connected to the i-th emission control line Ei. The fifth transistor M5 may be turned off when the emission control signal is supplied to the i-th emission control line Ei, and may be turned on in other cases. For example, when no emission control signal is supplied to the gate electrode of the fifth transistor M5, the fifth transistor M5 may be on.

The sixth transistor M6 may be connected between the second electrode of the first transistor M1 (in other words, the third node N3) and the first electrode of the light emitting device LD (in other words, the fourth node N4). A gate electrode of the sixth transistor M6 may be connected to the i-th emission control line Ei. The sixth transistor M6 may be turned off when the emission control signal is supplied to the i-th emission control line Ei, and may be turned on in other cases. For example, the sixth transistor M6 may be on when the fifth transistor M5 is on.

The seventh transistor M7 may be connected between a second initialization power source Vint2 and the fourth node N4. In an exemplary embodiment of the present invention, a gate electrode of the seventh transistor M7 may be connected to the (i−1)th first scan line S1*i*−1. The seventh transistor M7 may be wined on when the first scan signal is supplied to the (i−1)th first scan line S1i−1 so that the voltage of the second initialization power source. Vint2 may be supplied to the first electrode of the light emitting device LD.

In another exemplary embodiment of the present invention, the gate electrode of the seventh transistor M7 may be connected to the i-th first scan line S1*i* or an (i+1)th first scan line S1*i*+1. For example, when the sixth transistor M6 is turned off, the seventh transistor M7 may be turned on at any time.

When the voltage of the second initialization power source Vint2 is supplied to the first electrode of the light emitting device LD, a parasitic capacitor (e.g., a parasitic capacitance) of the light emitting device LD may be discharged. Since a residual voltage charged in the parasitic capacitor is discharged (removed), unintended micro light emission can be prevented. In other words, since the parasitic capacitance is discharged, the light emitting device LD does not accidentally emit light. Therefore, black expression capability of the pixel PX can be improved.

In addition, the first initialization power source Vint1 and the second initialization power source Vint2 may generate different voltages. In other words, the voltage for initializing the second node N2 and the voltage for initializing the fourth node N4 may be set differently.

During low-frequency driving in which the length of one frame period is increased, when the voltage of the first initialization power source Vint1 supplied to the second node N2 is too low, the hysteresis change of the first transistor M1 in the corresponding frame period may increase. Such hysteresis can cause flickering in the low-frequency driving. Therefore, in the display device 1000 driven at the low frequency, the voltage of the first initialization power source Vint1 higher than that of the second power source VSS may be required.

However, when the voltage of the second initialization power source Vint2 supplied to the fourth node N4 is higher than a predetermined reference voltage, the voltage of the parasitic capacitor of the light emitting device LD may be charged rather than discharged. Therefore, the second initialization power source Vint2 may be set to have a voltage lower than the predetermined reference voltage. For example, the second initialization power source Vint2 may have the voltage similar to that of the second power source VSS. However, this is merely an example, and the voltage of the second initialization power source Vint2 may be higher or lower than the voltage of the second power source VSS depending on the driving conditions of the display device 1000. In addition, a set of electrodes of the fourth and seventh transistors M4 and M7 may be connected to a common initialization power source.

The storage capacitor Cst may be connected between the first power source VDD and the second node N2. The storage capacitor Cst may store a voltage applied to the second node N2.

In addition, the first transistor M1 the second transistor M2, the fifth transistor M5, the sixth transistor M6, and the seventh transistor M7 may be polysilicon semiconductor transistors. For example, each of the first transistor M1, the second transistor M2, the fifth transistor M5, and the sixth transistor M6 may include a polysilicon semiconductor layer as an active layer (e.g. a channel). The polysilicon semiconductor layer may be thrilled through a low temperature poly-silicon (LTPS) process. In addition, the first transistor M1, the second transistor M2, the fifth transistor M5, and the sixth transistor M6 may be P-type transistors. Accordingly, a gate-on voltage for turning on the first transistor M1, the second transistor M2, the fifth transistor M5, and the sixth transistor M6 may be a logic low level.

The polysilicon semiconductor transistors have fast response speed, and thus, can serve as switching devices requiring fast switching.

The third transistor M3 and the fourth transistor M4 may be oxide semiconductor transistors. For example, the third transistor M3 and the fourth transistor M4 may be N-type oxide semiconductor transistors, and each may include an oxide semiconductor layer as an active layer. Accordingly, a gate-on voltage for turning on the third transistor M3 and the fourth transistor M4 may be a logic high level.

The oxide semiconductor transistors may be manufactured in a low temperature process and have a low charge mobility compared to the polysilicon semiconductor transistors. In other words, the oxide semiconductor transistors have excellent off-current characteristics. Therefore, when the third transistor M3 and the fourth transistor M4 are composed of the oxide semiconductor transistors, leakage current from the second node N2 can be minimized, thereby improving display quality.

In an exemplary embodiment of the present invention, the seventh transistor M7 may be an oxide semiconductor transistor. For example, the seventh transistor M7 may be an N-type oxide semiconductor transistor. In the alternative, the seventh transistor M7 may be a P-type transistor.

Figure 3A:
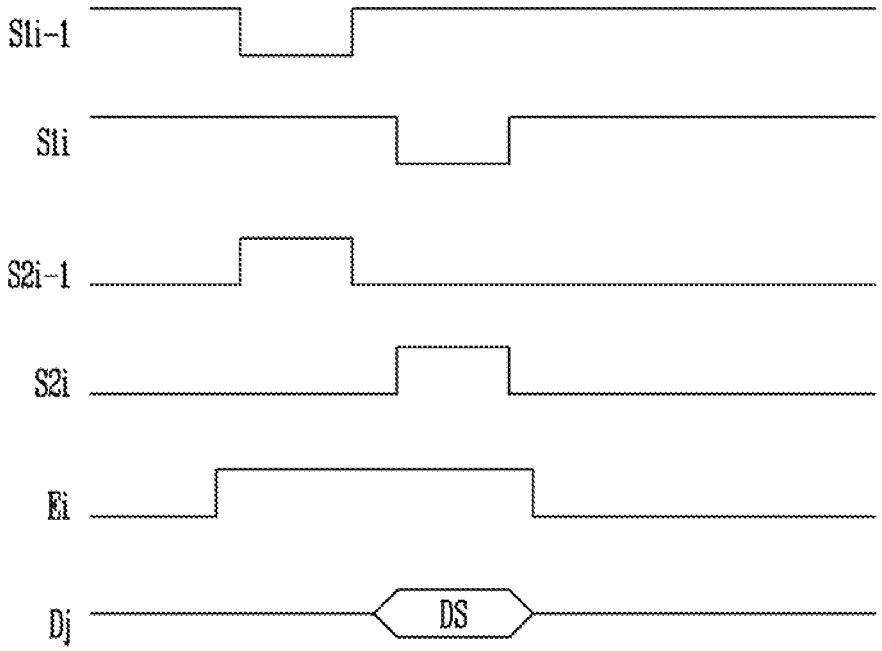
FIG. 3A is a timing diagram illustrating an example of driving the pixel of FIG. 2.

FIG. 3A is a timing diagram illustrating an example of driving the pixel PX of FIG. 2.

Referring to FIGS. 2 and 3A, the pixel PX may receive signals for displaying an image.

Hereinafter, for convenience of description, the i-th emission control line Ei may be referred to as the emission control line Ei, the i-th first scan line S1*i* may be referred to as the first scan line S1*i*, the i-th second scan line S2*i* may be referred to as the second scan line S2*i*, the (i−1)th first scan line S1*i*−1 may be referred to as the previous first scan line S1*i*−1, and the (i−1)th second scan line S2*i*−1 may be referred to as the previous second scan line S2*i*−1.

The gate-on voltage of the second scan signal supplied to the second scan lines S2*i*−1 and S2*i* connected to the third and fourth transistors M3 and M4, which are N-type transistors, may be at a logic high level. The gate-on voltage of the first scan signal supplied to the first scan lines S1*i*−1 and S1*i* connected to the first, second, and seventh transistors M1, M2, and M7, which are P-type transistors, may be at a logic low level. The gate-on voltage of the emission control signal supplied to the emission control line Ei connected to the fifth and sixth transistors M5 and M6, which are P-type transistors, may also be at the logic low level.

First, the emission control signal may be supplied to the emission control line Ei. When the emission control signal is supplied to the emission control line Ei, the fifth and sixth transistors M5 and M6 may be turned off. When the fifth and sixth transistors M5 and M6 are turned off, the pixel PX may not emit light.

Thereafter, the first and second scan signals may be supplied to the previous first scan line S1*i*−1 and the previous second scan line S2*i*−1. In an exemplary embodiment of the present invention, the first and second scan signals may overlap each other. For example, the first and second scan signals may have waveforms opposite to each other at the same timing. In other words, the first scan signal may be low and the second scan signal may be high and vice versa.

When the second scan signal is supplied to the previous second scan line S2*i*−1, the fourth transistor M4 may be turned on. When the fourth transistor M4 is turned on, the voltage of the first initialization power source Vint1 may be supplied to the second node N2. When the first scan signal is supplied to the previous first scan line S1*i*−1, the seventh transistor M7 may be turned on. When the seventh transistor M7 is turned on, the voltage of the second initialization power source Vint2 may be supplied to the first electrode of the light emitting device LD. Accordingly, the residual voltage remaining in the parasitic capacitor of the light emitting device LD may be discharged.

Thereafter, the first and second scan signals may be supplied to the first scan line S1*i* and the second scan line S2*i*. When the second scan signal is supplied to the second scan line S2*i*, the third transistor M3 may be turned on. When the third transistor M3 is turned on, the first transistor M1 may be connected in the form of a diode, and a threshold voltage of the first transistor M1 may be compensated.

When the first scan signal is supplied to the first scan line S1*i*, the second transistor M2 may be turned on. When the second transistor M2 is turned on, a data signal DS may be supplied from the data line Dj to the first node N1. At this time, since the second node N2 has been initialized to the voltage of the first initialization power source Vint1, which is lower than that of the data signal DS, the first transistor M1 may be turned on. In other words, the gate electrode of the first transistor M1 may be initialized to the on-bias state.

When the first transistor M1 is turned on, the data signal DS supplied to the first node N1 may be supplied to the second node N2 via the first transistor M1 connected in the form of a diode. Then, a voltage corresponding to the data signal DS and the threshold voltage of the first transistor M1 may be applied to the second node N2. In this case, the storage capacitor Cst may store the voltage of the second node N2.

Thereafter, supply of the emission control signal to the emission control line Ei may be stopped. When the supply of the emission control signal to the emission control line Ei is stopped, the fifth and sixth transistors M5 and M6 may be turned on. In this case, the first transistor M1 may control the driving current flowing to the light emitting device LD in response to the voltage of the second node N2. Then, the light emitting device LD may generate light of luminance corresponding to the amount of driving current provided thereto.

Figure 3B:
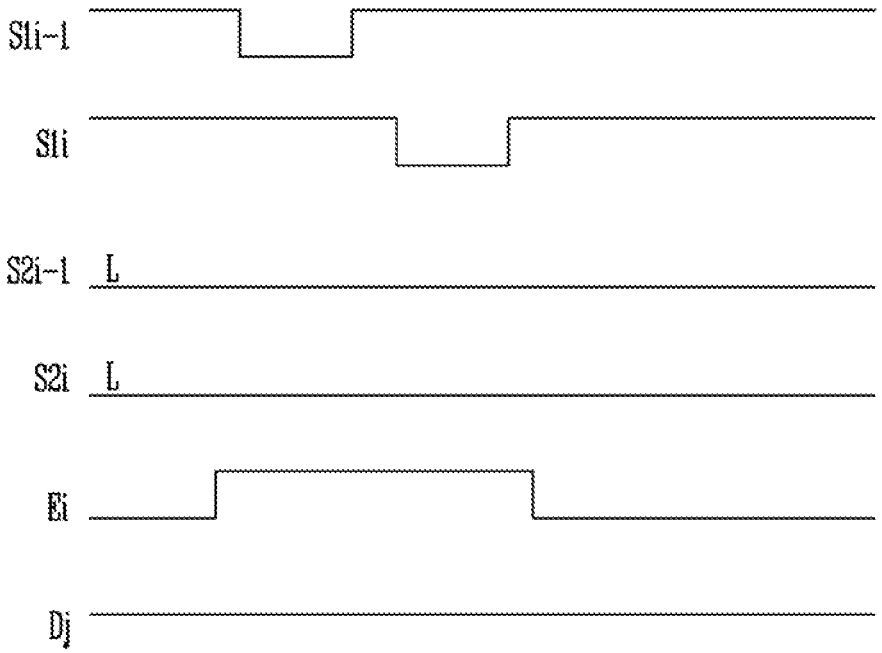
FIG. 3B is a timing diagram illustrating an example of driving the pixel of FIG. 2.

FIG. 3B is a timing diagram illustrating an example of driving of the pixel of FIG. 2.

Referring to FIGS. 2 and 3B, when the display device 1000 is driven in a first mode, which is a low power driving mode, a predetermined voltage may be periodically supplied to one electrode (for example, a source electrode or a drain electrode) of the first transistor M1 during a second period to maintain an image (and/or luminance) output in a period (for example, a first period) of FIG. 3A.

In an exemplary embodiment of the present invention, in the second period, the scan signal is not supplied to the third and fourth transistors M3 and M4. For example, in the second period, the second scan signal supplied to the previous second scan line S2*i*−1 and the second scan line S2*i* may have a logic low level L.

Since the third and fourth transistors M3 and M4 maintain a turn-off state. the gate voltage of the first transistor M1 is not affected by the driving of the second period.

In an exemplary embodiment of the present invention, in the second period, the first scan signal may be supplied to the previous first scan line S1*i*−1 and the first scan line S1*i* and the emission control signal may be supplied to the emission control line Ei.

In a state where the fifth and sixth transistors M5 and M6 are turned off in response to the emission control signal, the seventh transistor M7 and the second transistor M2 may be sequentially turned on in response to the first scan signal. When the seventh transistor M7 is turned on by the first scan signal of the low level, the voltage of the second initialization power source Vint2 may be supplied to the first electrode of the light emitting device LD.

In an exemplary embodiment of the present invention, a bias voltage for applying an on-bias to the first transistor M1 may be supplied to the data line D. Therefore, when the second transistor M2 is turned on by the first scan signal of the low level, the bias voltage may be supplied to the first node N1. For example, the bias voltage may have a voltage level of about 5V to about 7V. Each time the second transistor M2 is turned on in the second period, the first transistor M1 may be on-biased.

Accordingly, defects such as a recognizable luminance change and flicker can be minimized while the display device 1000 is driven at the low frequency.

Figure 4:
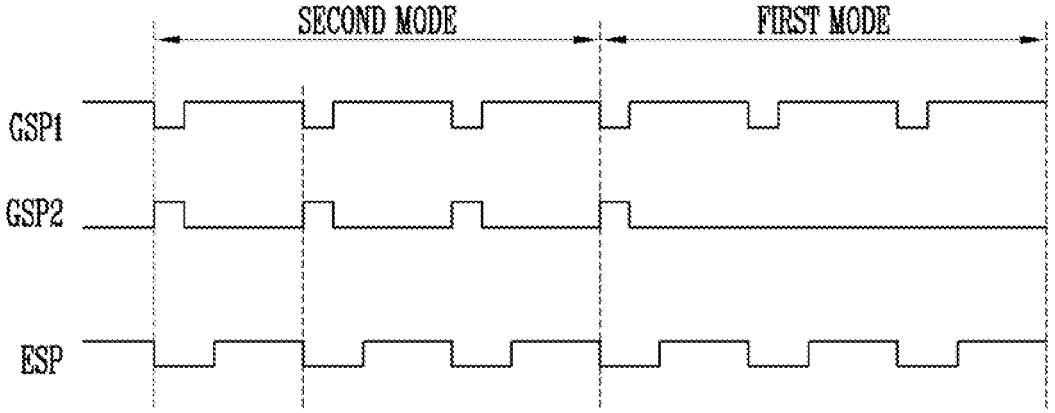
FIG. 4 is a timing diagram illustrating an example of start pulses supplied to scan drivers and an emission driver included in the display device of FIG. 1.

FIG. 4 is a timing diagram illustrating an example of start pulses supplied to the first and second scan drivers 200 and 300 and the emission driver 400 included in the display device 1000 of FIG. 1.

Referring to FIGS. 1, 2 and 4, the frequency of the second gate start pulse GSP2 may vary according to the driving mode of the display device 1000.

In an exemplary embodiment of the present invention, pulse widths of the first and second gate start pulses GSP1 and GSP2 may be substantially the same. In addition, the pulse width of the emission start pulse ESP may be greater than the pulse widths of the first and second gate start pulses GSP1 and GSP2.

In an exemplary embodiment of the present invention, the timing controller 600 may output the emission start pulse ESP and the first gate start pulse GSP1 at a constant frequency regardless of the image refresh rate. For example, the frequency of the emission start pulse ESP and the frequency of the first gate start pulse GSP1 may be set to be substantially the same as the maximum driving frequency (for example, a maximum refresh rate) of the display device 1000. In an exemplary embodiment of the present invention, when the image is displayed on the display device 1000 at a refresh rate of up to 120 Hz, the frequency of the emission start pulse ESP and the frequency of the first gate start pulse GSP1 may be 120 Hz.

Hereinafter, it is assumed that the display device 1000 is driven at a first image refresh rate (or a maximum image refresh rate) in the second mode (normal driving mode), and is driven at a second image refresh rate lower than the first image refresh rate in the first mode (for example, the low frequency mode or the low power driving mode).

In the first mode and the second mode, the timing controller 600 may generate the first gate start pulse GSP1 and the emission start pulse ESP at a first frequency.

The timing controller 600 may generate the second gate start pulse GSP2 at a second frequency corresponding to the second image refresh rate in the first mode, and generate the second gate start pulse GSP2 at the first frequency corresponding to the first image refresh rate in the second mode. In other words, the timing controller 600 may generate the second gate start pulse GSP2 to correspond to the image refresh rate.

Figure 5:
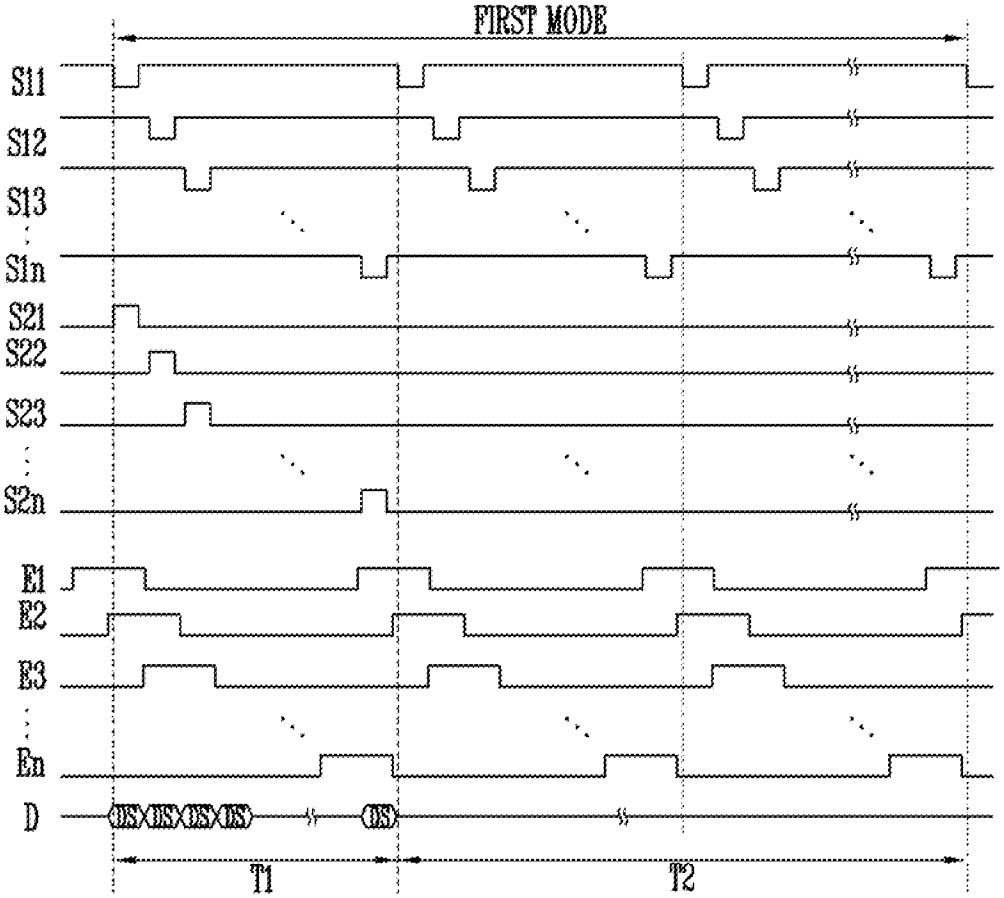
FIG. 5 is a timing diagram illustrating an example of a driving method when the display device of FIG. 1 is driven in a first mode.

FIG. 5 is a timing diagram illustrating an example of a driving method when the display device 1000 of FIG. 1 is driven in a first mode.

For example, the first mode may be set to a low frequency of less than 50 Hz. The first mode may be activated in a standby mode for reducing power consumption.

Referring to FIGS. 1 and 5, a period corresponding to the image refresh rate in the first mode may be divided into a first period T1 and a second period T2. Here, the second period T2 may be wider than the first period T1. In other words, the second period T2 may be longer than the first period T1.

In an exemplary embodiment of the present invention, the first scan signal may be supplied to the first scan lines S11 to S1*n* at the first frequency regardless of the driving mode, and the emission control signal may be supplied to the emission control lines E1 to En at the first frequency. Here, n is a natural number greater than 1. The first scan signal and the emission control signal may be periodically supplied in the first period T1 and the second period T2. For example, the first scan signal and the emission control signal may be supplied at 60 Hz.

In an exemplary embodiment of the present invention, the second scan signal supplied to the second scan lines S21 to S2*n* and the data signal DS corresponding thereto may be supplied at a frequency substantially the same as the image refresh rate (for example, the second frequency). When the image refresh rate is 1 Hz, the second scan signal may be supplied at 1 Hz. For example, at 1 Hz, the second scan signal may be supplied to the second scan line S2*i* once per second. In addition, the second scan signal may not be supplied in the second period T2.

The scan signal may be sequentially supplied to the first scan lines S11 to S1*n* and the second scan lines S21 to S2*n* during; the first period T1. Here, the first scan signal supplied to the first scan line S1*i* may overlap the second scan signal supplied to the second scan line S2*i*.

In addition, the emission control signal may be sequentially supplied to the emission control lines E1 to En during the first period T1. Here, the emission control signal supplied to the emission control line Ei may overlap the first scan signal supplied to the previous first scan line S1*i*−1 and the first scan line S1*i*.

In the second period T2, the emission control signal may be supplied to the emission control lines E1 to En, and the first scan signal may be supplied to the first scan lines S11 to S1*n*. For example, when the first frequency is 60 Hz, the first scan signal may be supplied to the first scan line S1*i* once during the first period T1, and the first scan signal may be supplied 59 times to the first scan line S1*i* during the second period T2. The emission control signal may also be supplied in the same way.

In addition, a predetermined bias voltage may be supplied to the data lines D during the second period T2.

Figure 6:
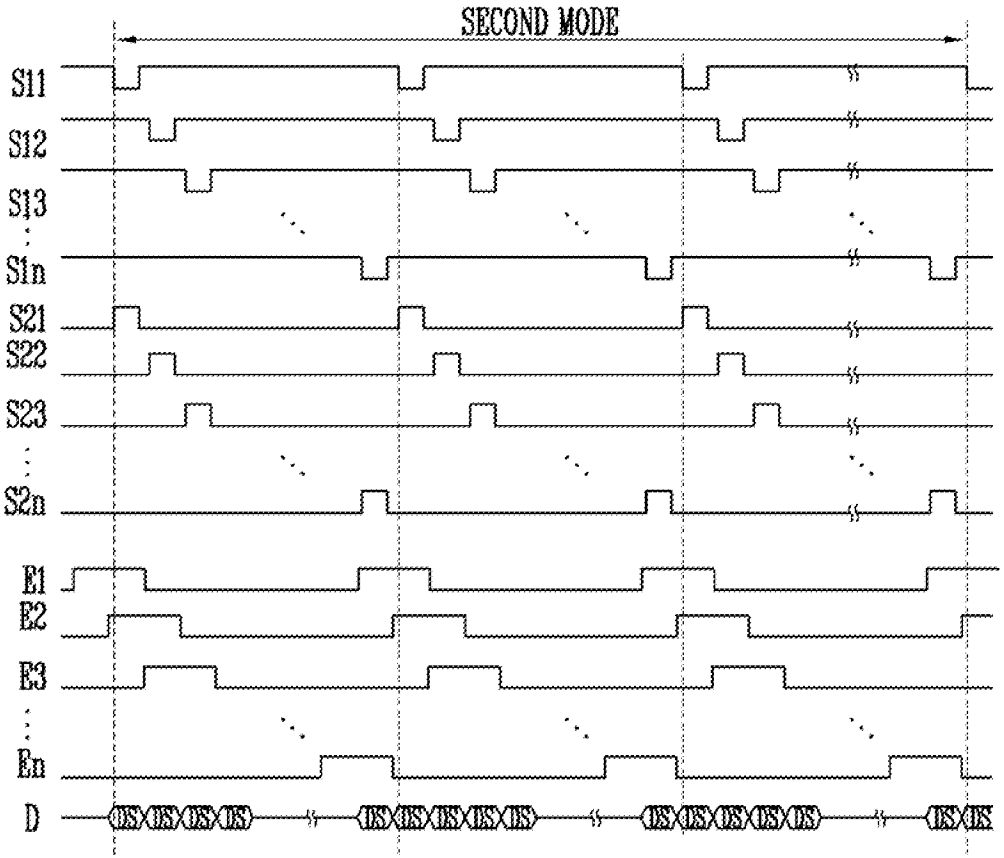
FIG. 6 is a timing diagram illustrating an example of a driving method when the display device of FIG. 1 is driven in a second mode.

FIG. 6 is a timing diagram illustrating an example of a driving method when the display device 1000 of FIG. 1 is driven in a second mode.

Referring to FIGS. 1 and 6, in the second mode, the first scan signal and the second scan signal may be output at the same frequency as the image refresh rate. For example, the image refresh rate may be set to 60 Hz or 120 Hz. The second mode may be a driving mode in which the display device 1000 displays a normal image.

In the second mode, the first and second scan signals may be sequentially supplied to the first scan lines S11 to S1*n* and the second scan lines S21 to S2*n* for one frame period, respectively. Here, the first scan signal supplied to the first scan line S1*i* may overlap the second scan signal supplied to the second scan line S2*i*.

Further, the emission control signal may be sequentially supplied to the emission control lines E1 to En during one frame 1F. Here, the emission control signal supplied to the emission control line Ei may overlap the scan signal supplied to the previous first scan line S1*i*−1 and the first scan line S1*i*. The data signal DS may be supplied to the data lines D to be synchronized with the first scan signal.

The pixels PX may emit light in response to the data signal DS and the image may be displayed in the pixel unit 100.

Figure 7:
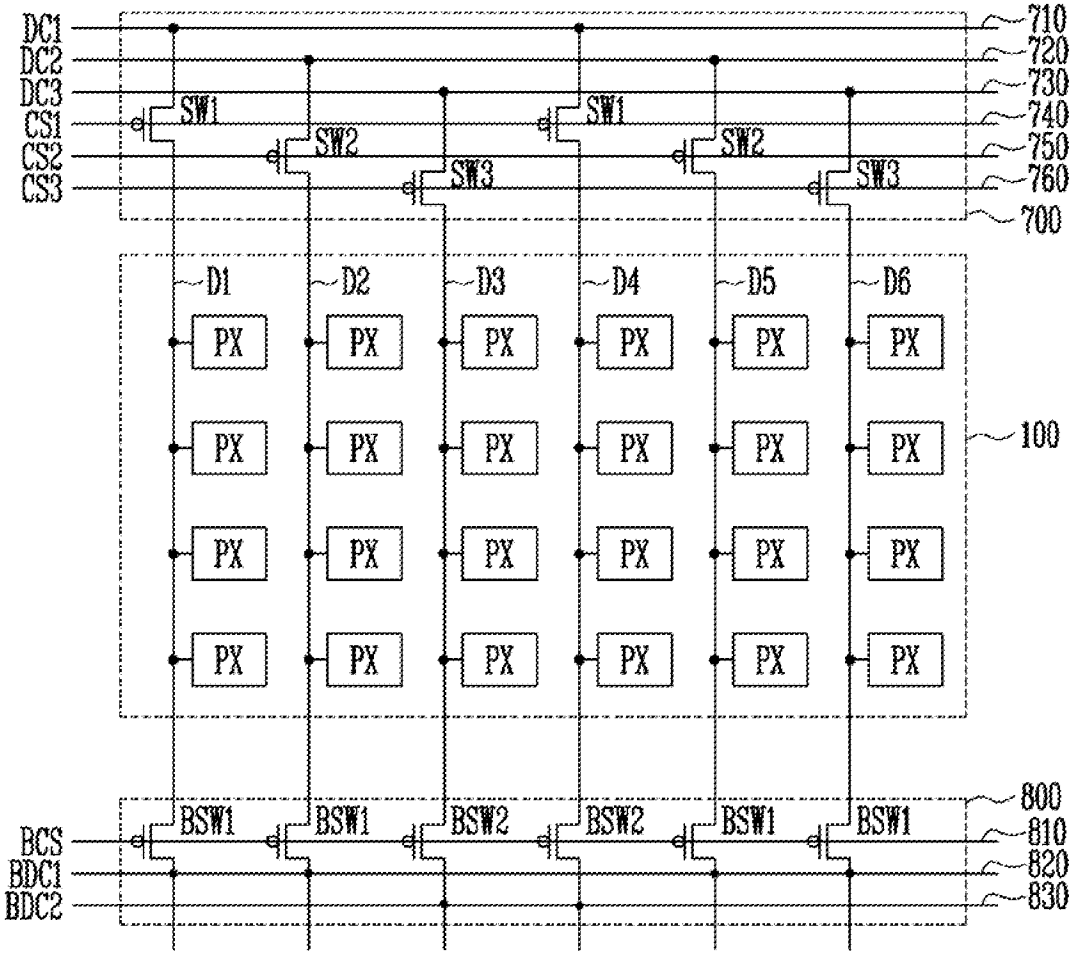
FIG. 7 is a diagram illustrating an example of a portion the display device of FIG. 1.

FIG. 7 is a diagram illustrating an example of a portion of the display device 1000 of FIG. 1.

FIG. 7 shows a portion of the display device 1000. Referring to FIGS. 1, 2 and 7, the display device 1000 may further include a first signal supply 700 and a second signal supply 800.

In an exemplary embodiment of the present invention, the first and second signal supplies 700 and 800 may be formed separately from the data driver 500 and the timing controller 600. The first and second signal supplies 700 and 800 may be used for lighting inspection of the pixel unit 100. For example, the first and second signal supplies 700 and 800 may supply predetermined inspection signals to data lines D1, D2, D3, D4, D5 and D6 for the lighting inspection in the first mode and the lighting inspection in the second mode.

The lighting inspection may include analysis of input/output values of the inspection signals and analysis of luminance and/or color coordinates of the pixels PX emitting light based on the inspection signals. The lighting inspection may be performed by various methods.

Hereinafter, an example in which the first mode and the second mode are implemented by adjusting the frequency of the second scan driver 300 for the lighting inspection will be described.

The first signal supply 700 may be disposed on one side of the pixel unit 100, and the second signal supply 800 may be disposed on the another side of the pixel unit 100. For example, the pixel unit 100 may be disposed between the first and second signal supplies 700 and 800. In an exemplary embodiment of the present invention, switches included in the first signal supply 700 and the second signal supply 800 may be formed in the same structure as the transistors included in the pixel PX in the process of forming the transistors included in the pixel PX. Therefore, manufacturing efficiency can be improved.

The first signal supply 700 may supply inspection signals DC1, DC2, and DC3 to the pixels PX through the data lines D1 to D6 in response to the second scan signal in the first mode. In an exemplary embodiment of the present invention, the first signal supply 700 may supply at least one of the inspection signals DC1, DC2, and DC3 to at least one of the data lines D1 to D6 during the first period of the first mode. The pixels PX may emit light in response to the inspection signals DC1, DC2, and DC3 supplied thereto.

The first signal supply 700 may include inspection lines 710, 720, and 730 for transmitting the inspection signals DC1, DC2, and DC3, control lines 740, 750, and 760 for transmitting inspection control signals CS1, CS2, and CS3 and switches SW1, SW2, and SW3.

For example, first, second, and third inspection signals DC1, DC2, and DC3 in a direct current form may be respectively supplied to first, second, and third inspection lines 710, 720, and 730. For example, the first inspection signal DC1 may be a red inspection signal, the second inspection signal DC2 may be a green inspection signal, and the third inspection signal DC3 may be a blue inspection signal. In this case, a pixel column connected to a first data line D1 may include red pixels, a pixel column connected to a second data line D2 may include green pixels, and a pixel column connected to a third data line D3 may include blue pixels. However, this is merely an example and the arrangement of the pixels PX is not limited thereto.

For example, a first switch SW1 may be electrically connecter between the first inspection line 710 and the first data line D1. The first switch SW1 may be turned on by a first inspection control signal CS1 supplied to a first control line 740. For example, the first inspection control signal CS1 is supplied to a gate electrode of the first switch SW1 to turn on the first switch SW1. When the first switch SW1 is turned on, the first inspection signal DC1 may be supplied to the first data line D1. The first inspection signal DC1 may be sequentially supplied to the pixels PX connected to the first data line D1 in synchronization with the first scan signal. However, this is merely an example, and the first scan signal may be simultaneously supplied to a plurality of horizontal lines. Another first switch SW1 may be electrically connected between the first inspection line 710 and the fourth data line D4.

A second switch SW2 may be electrically connected between the second inspection line 720 and the second data line D2. The second switch SW2 may be turned on by a second inspection control signal CS2 supplied to a second control line 750. When the second switch SW2 is turned on, the second inspection signal DC2 may be supplied to the second data line D2. Another second switch SW2 may be electrically connected between the second inspection line 720 and the fifth data line D5.

A third switch SW3 may be electrically connected between the third inspection line 730 and the third data line D3. The third switch SW3 may be turned on by a third inspection control signal CS3 supplied to a third control line 760. When the third switch SW3 is turned on, the third inspection signal DC3 may be supplied to the third data line D3. Another third switch SW3 may be electrically connected between the third inspection line 730 and the sixth data line D6.

The second inspection signal DC2 and the third inspection signal DC3 may be sequentially supplied to the pixels PX connected to the second data line D2 and the pixels PX connected to the third data line D3 in synchronization with the first scan signal, respectively.

The first, second, and third switches SW1, SW2, and SW3 may be repeatedly arranged in a horizontal line direction. For example, the another first switch SW1 may be connected to the fourth data line D4, the another second switch SW2 may be connected to the fifth data line D5, and the another third switch SW3 may be connected to the sixth data line D6.

The second signal supply 800 may supply bias signals BDC1 and BDC2 to the data lines D1 to D6 during the second period of the first mode. The bias signals BDC1 and BDC2 may be supplied to the pixels PX through the data lines D1 to D6 in response to the first scan signal.

Each of the bias signals BDC1 and BDC2 may be supplied to the source electrode (and/or the drain electrode) of the first transistor M1 of the pixel PX. Accordingly, in the second period of the low-frequency driving, an on-bias voltage may be periodically applied to the first transistor M1.

The second signal supply 800 may include power lines 820 and 830 for transmitting the bias signals BDC1 and BDC2, a bias control line 810 for transmitting a bias control signal BCS, and bias switches BSW1 and BSW2.

A first bias switch BSW1 may be electrically connected between the first data line D1 and a first power source line 820. The first bias switch BSW1 may be turned on by the bias control signal BCS. For example, the bias control signal BCS is supplied to a gate electrode of the first bias switch BSW1 to turn on the first bias switch BSW1. When the first bias switch BSW1 is turned on, a first bias signal BDC1 may be supplied to the first data line D1. The first bias signal BDC1 may be supplied to the pixels PX connected to the first data line D1 in synchronization with the first scan signal. Another first bias switch BSW1 may be electrically connected between the second data line D2 and the first power source line 820.

A second bias switch BSW2 may be electrically connected between the third data line D3 and a second power source line 830. The second bias switch BSW2 may be turned on by the bias control signal BCS. When the second bias switch BSW2 is turned on, a second bias signal BDC2 may be supplied to the third data line D3. The second bias signal BDC2 may be supplied to the pixels PX connected to the third data line D3 in synchronization with the first scan signal. The second bias switch BSW2 may be electrically connected between the fourth data line D4 and the second power source line 830.

The first and second bias switches BSW1 and BSW2 may be repeatedly arranged in the horizontal line. For example, two additional first bias switches BSW1 may be connected the fifth and sixth data lines D5 and D6. In addition, the first and second bias switches BSW1 and BSW2 may be commonly controlled.

In an exemplary embodiment of the present invention, the first and second bias signals BDC1 and BDC2 may be direct current (DC) voltages and may have substantially the same voltage level. The first and second bias signals BDC1 and BDC2 may be voltages for on-biasing the first transistor M1 and may be set within a range of about 5V to 7V.

In an exemplary embodiment of the present invention, a set of electrodes of the respective first bias switches BSW1 may be electrically connected to each other through the first power source line 820. For example, as shown in FIG. 7, the first bias switches BSW1 adjacent to each other may be connected to each other through the first power source line 820. Accordingly, two data lines (for example, the first data line D1 and the second data line D2) may be electrically connected to each other. By employing this configuration, a short inspection and/or an open inspection of the data lines D1 to D6 and/or fan-out lines connected thereto may be performed. In other words, it may be determined if a short or an open exists with respect to the data lines D1 to D6 and/or the fan-out lines.

Similarly, a set of electrodes of the respective second bias switches BSW2 may be electrically connected to each other through the second power source line 830.

Figure 8:
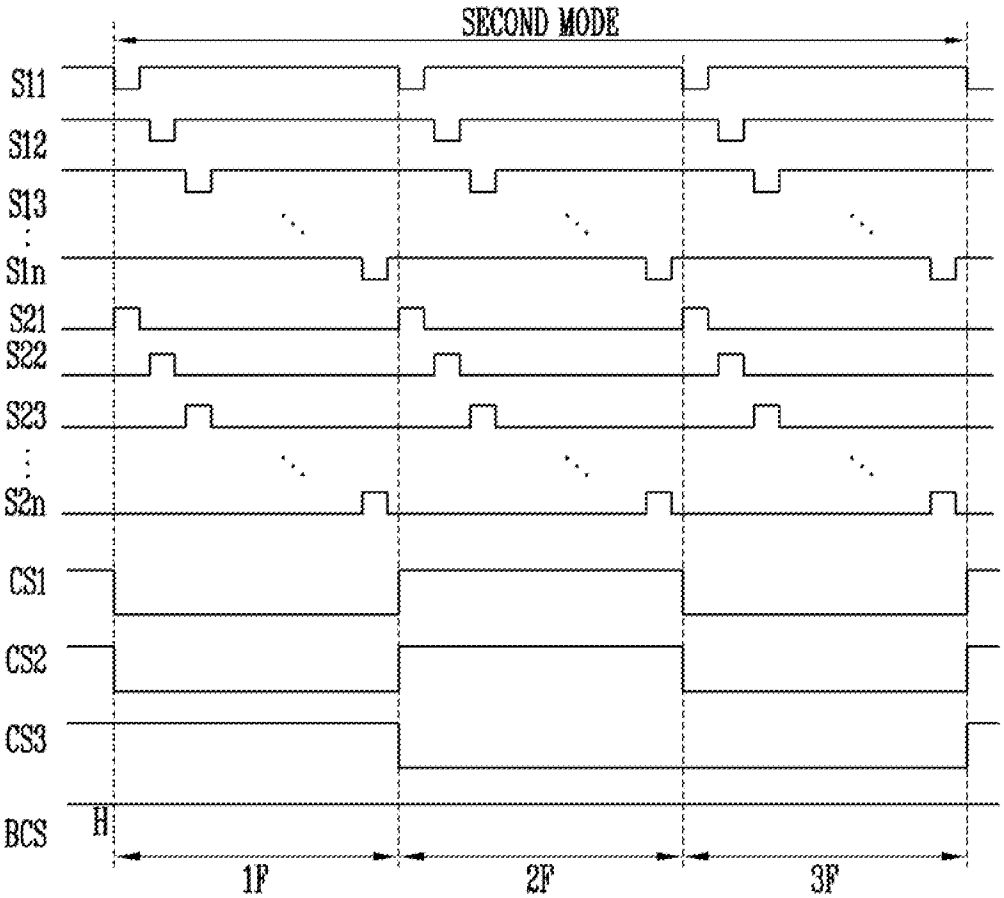
FIG. 8 is a timing diagram illustrating an example of a driving method when the display device of FIG. 7 performs a lighting inspection in a second mode.

FIG. 8 is a timing diagram illustrating an example of a driving method when the display device of FIG. 7 performs lighting inspection in a second mode.

Referring to FIGS. 1, 6, 7 and 8, when the lighting inspection is performed in the second mode, the first scan signal and the second scan signal may be output at the same frequency as the image refresh rate.

In an exemplary embodiment of the present invention, in the second mode, at least one of the first, second, and third inspection control signals CS1, CS2, and CS3 may be supplied in units of frames. The bias control signal BCS may not be supplied in the second mode. For example, the bias control signal BCS may have a logic high level H, and the first and second bias switches BSW1 and BSW2 may be turned off.

The first and second inspection control signals CS1 and CS2 may be supplied to the first signal supply 700 in the first frame 1F. Therefore, the first and second switches SW1 and SW2 may be turned on and the first inspection signal DC1 or the second inspection signal DC2 may be supplied to the first, second, fourth, and fifth data lines D1, D2, D4, and D5. The pixels PX connected to the first and fourth data lines D1 and D4 may emit light by the first inspection signal DC1. The pixels PX connected to the second and fifth data lines D2 and D5 may emit light by the second inspection signal DC2.

In the first frame 1F, the lighting inspection of the pixels PX connected to the first, second, fourth and fifth data lines D1, D2, D4, and D5 may be performed.

In addition, the third inspection control signal CS3 may not be supplied during the first frame 1F, and the pixels PX connected to the third and sixth data lines D3 and D6 may not emit light.

The third inspection control signal CS3 may be supplied during a second frame 2F, and the first and second inspection control signals CS1 and CS2 may not be supplied during the second frame 2F. Accordingly, the lighting inspection of the pixels PX connected to the third and sixth data lines D3 and D6 may be performed.

All of the first to third switches SW1 to SW3 may be turned on by the first to third inspection control signals CS1 to CS3 during a third frame 3F. Therefore, all of the pixels PX may emit light, and the lighting inspection may be performed on all of the pixels PX.

Figure 9:
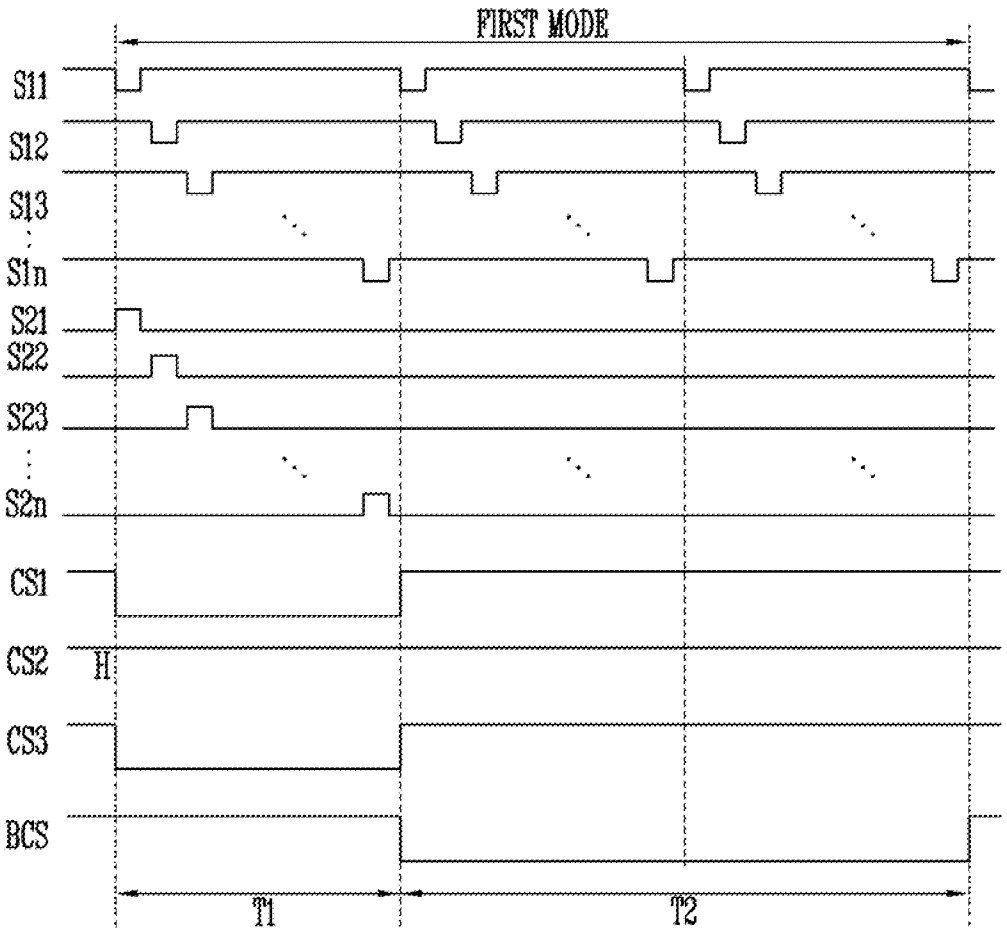
FIG. 9 is a timing diagram illustrating an example of a driving method when the display device of FIG. 7 performs a lighting inspection in a first mode.

FIG. 9 is a timing diagram illustrating an example of a driving method when the display device of FIG. 7 performs lighting inspection in a first mode.

Referring to FIGS. 1, 2, 6, 7 and 9, when the lighting inspection is performed in the first mode, the first scan signal may be output to the first scan lines S11 to S1*n* at a first frequency, and the second scan signal may be output to the second scan lines S21 to S2*n* at a second frequency.

The second frequency may be equal to the image refresh rate and may be less than the first frequency. For example, the first frequency may be 60 Hz or 120 HZ, and the second frequency may be a low frequency of 30 Hz or less.

The first mode may include the first period T1 and the second period T2. At least some of the first to third inspection control signals CS1 to CS3 may be supplied in the first period T1. Accordingly, one of the first to third inspection signals DC1 to DC3 may be written into the first transistor M1 included in the pixel PX.

As shown in FIG. 9, in the first period T1, the first and third inspection control signals CS1 and CS3 may be supplied to the first and third switches SW1 and SW3 through the first and third control lines 740 and 760, respectively. Accordingly, the first inspection signal DC1 may be supplied to the first and fourth data lines D1 and D4, and the third inspection signal DC3 may be supplied to the third and sixth data lines D3 and D6. The pixels PX connected to each of the first and fourth data lines D1 and D4 may emit light based on the first inspection signal DC1, and the pixels PX connected to each of the third and sixth data lines D3 and D6 may emit light based on the third inspection signal DC3. In FIG. 9, the second inspection control signal CS2 is supplied at a high level.

In this case, the first to third inspection signals DC1 to DC3 may have DC voltages corresponding to a predetermined data voltage.

In addition, when the lighting inspection is performed in the second mode where the low-frequency driving is performed, the second transistor M2 of the pixel PX may be periodically turned on by the first scan signal in the second period T2. When the second transistor M2 is turned on, each of the data lines D1 to D6 may be electrically connected to the first electrode (the source electrode or the drain electrode) of the first transistor M1 of the pixel PX.

In the second period T2, when the voltage level of the signal supplied to the data lines D1 to D6 is variable, the voltage of the first electrode of the first transistor M1 may be unstable. Therefore, light emitted from the pixels PX in the second period T2 may be visually recognized as flickering, and an accurate lighting inspection may not be obtained.

In another example, if the signal having an inappropriate voltage level is supplied to the data lines D1 to D6 in response to the first scan signal during the second period T2, luminance in the second period T2 may be gradually lowered, and the accurate lighting inspection may not be obtained.

The display device 1000 according to exemplary embodiments of the present invention may include the second signal supply 800 so that DC bias voltages (for example, BDC1 and BDC2) may be supplied to the data lines D1 to D6 during the second period T2 of the first mode.

The first to third inspection control signals CS1 to CS3 may not be supplied during the second period T2, and the first signal supply 700 and the data lines D1 to D6 may not be electrically connected. However, during the second period T2, the bias control signal BCS may be supplied to the second signal supply 800 so that the first and second bias switches BSW1 and BSW2 may be turned on.

When the first and second bias switches BSW1 and BSW2 are turned on, the data lines D1 to D6 and the first power source line 820 or the second power source line 830 may be electrically connected to each other. In other words, during the second period T2, the electrical connection between the data lines D1 to D6 and the first signal supply 700 may be disconnected, and the data lines D1 to D6 may be electrically connected to the second signal supply 800.

Therefore, during the second period T2, DC bias signals (for example, BDC1 and BDC2) may be supplied to the source electrode and/or the drain electrode of the first transistor M1 of the pixels PX through the data lines D1 to D6. Accordingly, the first transistor M1 may be periodically on-biased in the second period T2, and the luminance may be kept constant during the low-frequency driving. If the luminance remains constant, accuracy of the lighting inspection for the low-frequency driving can be improved. As can be seen, the first signal supply 700 and the second signal supply 800 may be used to supply a signal to the pixels PX when inspecting a panel driven at a low frequency.

In addition, a conductive path may be formed between predetermined data lines during the second period T2. This way, the short inspection and/or the open inspection of the data lines D1 to D6 and/or fan-out lines connected thereto may be performed in the second period T2.

Figure 10A:
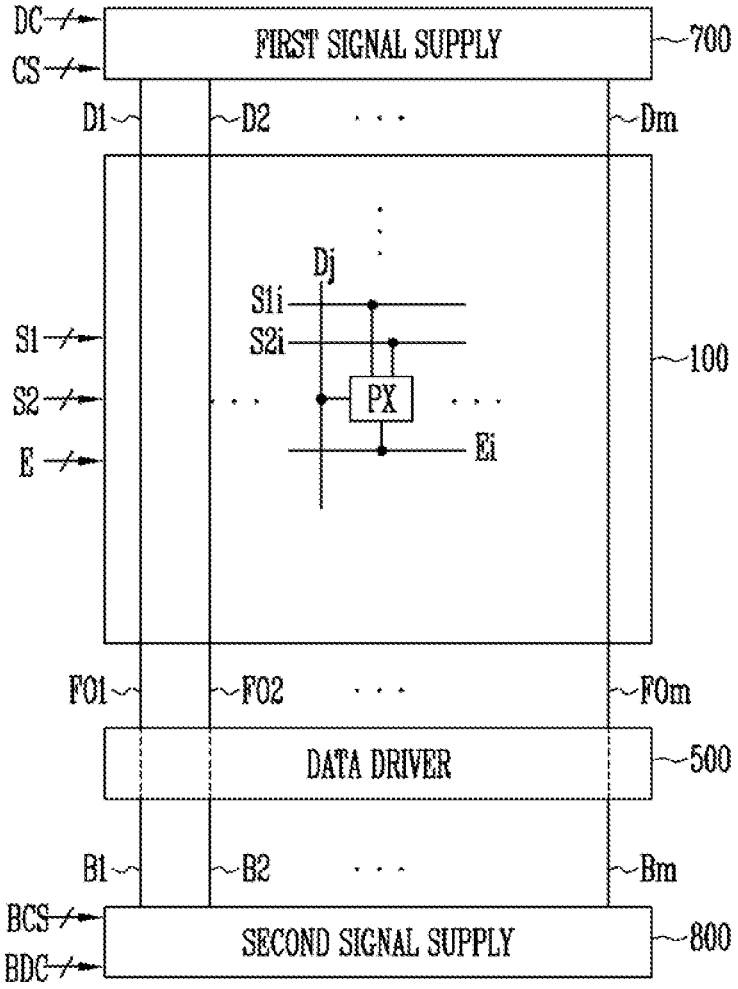
FIG. 10A is a diagram illustrating an example of the display device of FIG. 1.
Figure 10B:
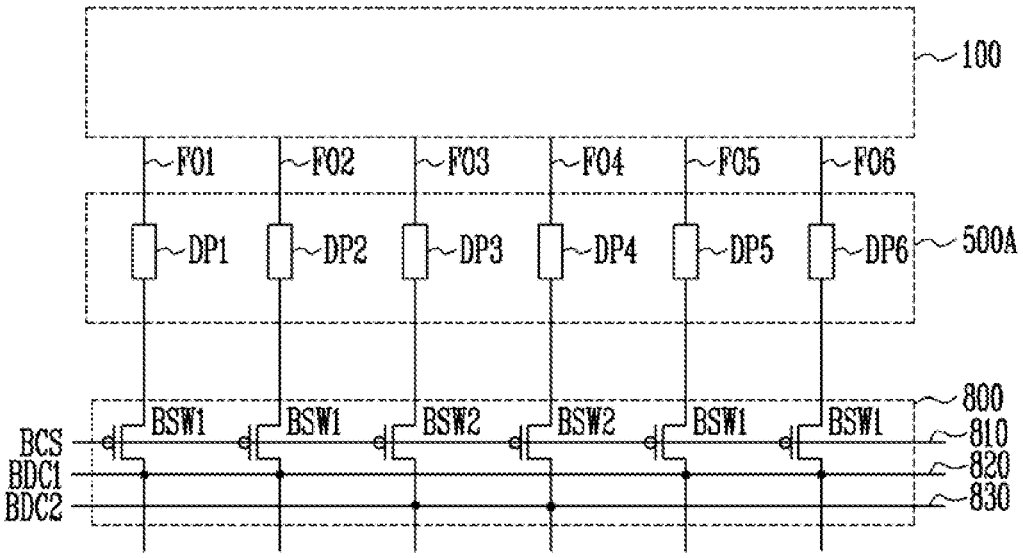
FIG. 10B is a diagram illustrating an example of a portion of the display device of FIG. 10A.

FIG. 10A is a diagram illustrating an example of the display device 1000 of FIG. 1. FIG. 10B is a diagram illustrating an example of a portion of the display device of FIG. 10A.

Referring to FIGS, 1, 7, 10A and 10B, the display device 1000 may include the pixel unit 100, the first and second scan drivers (200 and 300 in FIG. 1), the emission driver (400 in FIG. 1), the data driver 500, the timing controller (600 in FIG. 1), the first signal supply 700, and the second signal supply 800.

The pixel unit 100 may be formed on the substrate of the display device 1000. The pixel unit 100 may include a pixel circuit layer in which pixel circuits including the transistors are formed and a light emitting device layer disposed on the pixel circuit layer.

In an exemplary embodiment of the present invention, the first signal supply 700 and the second signal supply 800 may be formed in the pixel circuit layer on the substrate. For example, the first signal supply 700 and the second signal supply 800 including a plurality of switches and signal lines may be formed in the same manufacturing process as the pixel circuits.

In an exemplary embodiment of the present invention, the first signal supply 700 may be disposed on one side of the pixel unit 100. The first signal supply 700 may be connected to the data lines D1 to Dm. The first signal supply 700 may supply the inspection signals DC to the data lines D1 to Dm in response to the inspection control signals CS.

In an exemplary embodiment of the present invention, the second signal supply 800 may be disposed on the other side of the pixel unit 100. A mounting area 500A on which the data driver 500 (or a data driver integrated circuit (IC)) is mounted may be disposed between the pixel unit 100 and the second signal supply 800.

In an exemplary embodiment of the present invention, the data driver 500 may be connected to the data lines D1 to Dm through fan-out lines FO1 to FOm on the substrate. For example, as shown in FIG. 10B the data driver 500 may be electrically connected to data pads DP1, DP2, DP3, DP4, DP5 and DP6 positioned in the mounting area 500A of the substrate, and the data pads DP1 to DP6 may be connected to the fan-out lines FO1, FO2, FO3, FO4, FO5 and FO6.

The second signal supply 800 may be connected to the fan-out lines FO1 to FOm through bias lines B1 to Bm. For example, the fan-out lines FO1 to FOm and the bias lines B1 to Bm may be connected to each other through the data pads (for example, shown as DP1 to DP6 in FIG. 10B).

The second signal supply 800 may supply the DC bias signals BDC1 and BDC2 to the data lines D1 to Dm in response to the bias control signal BCS. For example, the DC bias signals BDC1 and BDC2 may be supplied to the data lines D1 to Dm through the bias lines B1 to Bm and the fan-out lines FO1 to FOm.

As described above, the display device and the driving method thereof according to exemplary embodiments of the present invention may include the configuration and operation of the second signal supply 800 that periodically on-biases the driving transistor (for example, the first transistor M1) of the pixel PX during the lighting inspection for the low-frequency driving. Therefore, during the lighting inspection for the low-frequency driving, the luminance change of the pixel unit 100 may be minimized, and flicker can be eliminated or minimized. As a consequence, the lighting inspection for the low-frequency driving can be performed without errors, and the accuracy of the lighting inspection can be improved.

While the present invention has been described with reference to exemplary embodiments thereof, those skilled in the art will appreciate that various changes in form and details may be made thereto without departing from the spirit and scope of the present invention as set forth in the following claims.

What is claimed is:

1. A pixel comprising:

a light emitting device;

a first transistor including a first electrode connected to a first node electrically connected to a first power source, and controlling a driving current based on a voltage of a second node;

a second transistor connected between a data line and the first node, and turned on in response to a first scan signal;

a third transistor connected between a third node connected to a second electrode of the first transistor and the second node, and turned on in response to a second scan signal;

a fourth transistor connected between the third node and an initialization power source, and turned on in response to the second scan signal;

a fifth transistor connected between the first power source and the first node, and turned off in response to an emission control signal; and a sixth transistor connected between the third node and a first electrode of the light emitting device, and turned off with the fifth transistor, wherein the second transistor is electrically connected to a first scan line, the first scan signal being supplied to the first scan line at a first frequency, wherein the fourth transistor is electrically connected to a second scan line, the second scan signal being supplied to the second scan line at a second frequency, the second frequency being different from the first frequency, wherein an inspection signal is supplied to the data line in response to the first scan signal in a first period, and wherein a bias signal is supplied to the first transistor through the data line in response to the first scan signal in a second period.

2. The pixel of claim 1, wherein the first scan signal is supplied to the first scan line at the first frequency in a first mode, wherein the second scan signal is supplied to the second scan line at the second frequency in the first mode, wherein the inspection signal is supplied to the data line in the first period of the first mode, and wherein the bias signal is supplied to the data line in the second period of the first mode.

3. The pixel of claim 1 further comprising a seventh transistor electrically connected between a second initialization power source and the light emitting device.

4. The pixel of claim 1, wherein the second frequency is lower than the first frequency.

5. The pixel of claim 1, wherein the second scan signal supplied to the pixel overlaps the first scan signal supplied to the pixel.

6. The pixel of claim 1, wherein the first scan signal and the second scan signal are supplied to the pixel in the first period, and wherein the first scan signal is supplied to the pixel in the second period.

7. The pixel of claim 1, wherein the first scan signal and the second scan signal are supplied to the pixel through the first scan line and the second scan line, respectively, at the first frequency in a second mode, the second mode being different from the first mode.

8. The pixel of claim 7, wherein the first scan signal and the second scan signal are simultaneously supplied to the pixel in the second mode.

9. The pixel of claim 7, wherein the bias signal is not supplied to the data line in the second mode, and wherein the inspection signal is supplied to the pixel through the data line in response to the first scan signal in the second mode.

10. The pixel of claim 1, wherein the pixel emits light in response to the inspection signal.

11. The pixel of claim 1, wherein the inspection signal is supplied from a first signal supply and the bias signal is supplied from a second signal supply.

12. The pixel of claim 1, wherein the third transistor includes an oxide semiconductor layer, and wherein the fourth transistor includes an oxide semiconductor layer.

* * * * *